United States Patent [19]

Camilleri

[11] 4,084,817

[45] Apr. 18, 1978

[54] CUSHION BLOCKS

[76] Inventor: Thomas M. Camilleri, 277 Ave. W, Brooklyn, N.Y. 11226

[21] Appl. No.: 680,182

[22] Filed: Apr. 26, 1976

[51] Int. Cl.[2] ..... A63D 5/00

[52] U.S. Cl. ..... 273/53; 248/251

[58] Field of Search ..... 273/53; 248/15, 251, 248/254, 261, 262; 242/55.2

[56] References Cited

U.S. PATENT DOCUMENTS

| | | | |
|---|---|---|---|
| 1,187,705 | 6/1916 | Calvert | 242/55.2 |
| 1,805,267 | 5/1931 | Treiber | 273/53 |
| 2,068,902 | 1/1937 | Blunt | 248/251 X |
| 3,096,090 | 7/1963 | Albrecht | 273/53 |

FOREIGN PATENT DOCUMENTS

| | | | |
|---|---|---|---|
| 2,147,301 | 3/1973 | Germany | 248/251 |

*Primary Examiner*—Anton O. Oechsle
*Attorney, Agent, or Firm*—Donald J. Perrella

[57] ABSTRACT

A cushion block assembly for a cylinder which supports a bowling ball backstop consists of two substantially U-shaped blocks, one block provided with means to lock the cylinder, the other block provided with a hub over which the cylinder is fitted.

19 Claims, 3 Drawing Figures

CUSHION BLOCKS

BACKGROUND OF THE INVENTION

The present invention relates to a cushion block assembly for a cylinder which supports a bowling ball backstop for an automatic pinsetting or pinspotting machine for bowling alleys. Cushion block assemblies presently used for such purposes do not permit rapid installation and removal to the cylinder which supports the bowling ball backstop. One of the blocks must be removed to install or remove the bowling ball backstop. The presently used cushion block assemblies permit upward movement of the cylinder. When the shock absorber attached to the bowling ball backstop is worn, the upward movement may be sufficient to permit the bowling ball to become wedged under the bowling ball backstop.

OBJECTS OF THE INVENTION

It is an object of the present invention to provide a cushion block assembly which permits simple and rapid installation and removal of the cylinder which supports the bowling ball backstop. Another object is to provide a cushion blocks which restricts upward or downward movement of the cylinder during normal operation of the pinsetting or pinspotting machine while permitting rotation. Still another object is to provide a cushion block assembly for a bowling ball backstop support cylinder which minimizes damage to the shock absorber attached to the bowling ball backstop. These and other objects of the present invention will be apparent from the following description.

SUMMARY OF THE INVENTION

A cushion block assembly adapted to receive a cylindrical tube or rod which supports a bowling ball backstop consists of two substantially U-shaped blocks one block provided with means to lock the cylinder, the other block provided with a hub over which the cylinder is fitted.

DETAILED DESCRIPTION

Figure 1:
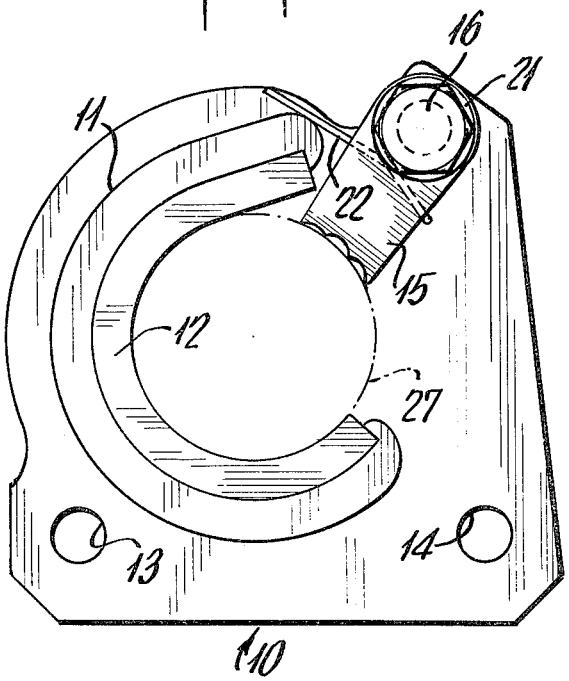
FIG. 1 is a side elevation of one cushion block of the present invention.

FIG. 1 shows a cushion block consisting of a plate 10 having a raised substantially U-shaped portion 11 the inner surface of which is lined with a layer 12 of cushioning material, e.g., latex, neoprene, isoprene, SBR, urethane, or the like. Openings 13 and 14 are adapted to receive fastening members, e.g., bolts or screws, to fasten plate 10 to the housing of the pinsetting or pinspotting machine. A third similar opening is provided beneath lever locking member 15 and is shown by a broken circle.

Member 15 is pivotably attached to plate 10 by bolt 16, washers 17 and 21 and nut 18. Member 15 has a length sufficient to enable it to contact cylindrical rod or tube 27 (shown by broken lines). A spring 22 passes over one end of raised substantialy U-shaped portion 11 and under member 15 and then bends to cross the side of member 15. The spring holds member 15 in locking engagement with rod or tube 27 whereby displacement of the latter from the raised substantially U-shaped portion 11 is prevented. The end of member 15 which contacts the rod or tube may be serrated to provide better frictional engagement.

Figure 2:
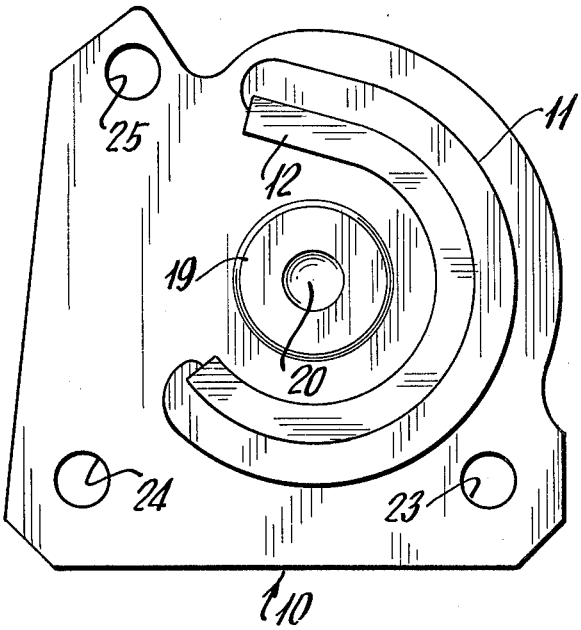
FIG. 2 is a side elevation of the complementary cushion block.

FIG. 2 shows a complementary cushion block consisting of a plate 10 having a similar raised substantially U-shaped portion 11, cushioning layer 12 and openings 23, 24 and 25 for fastening the plate to the housing. The central portion of the substantially U-shaped portion is provided with a frusto-conical hub 19 having a central depression 20.

Figure 3:
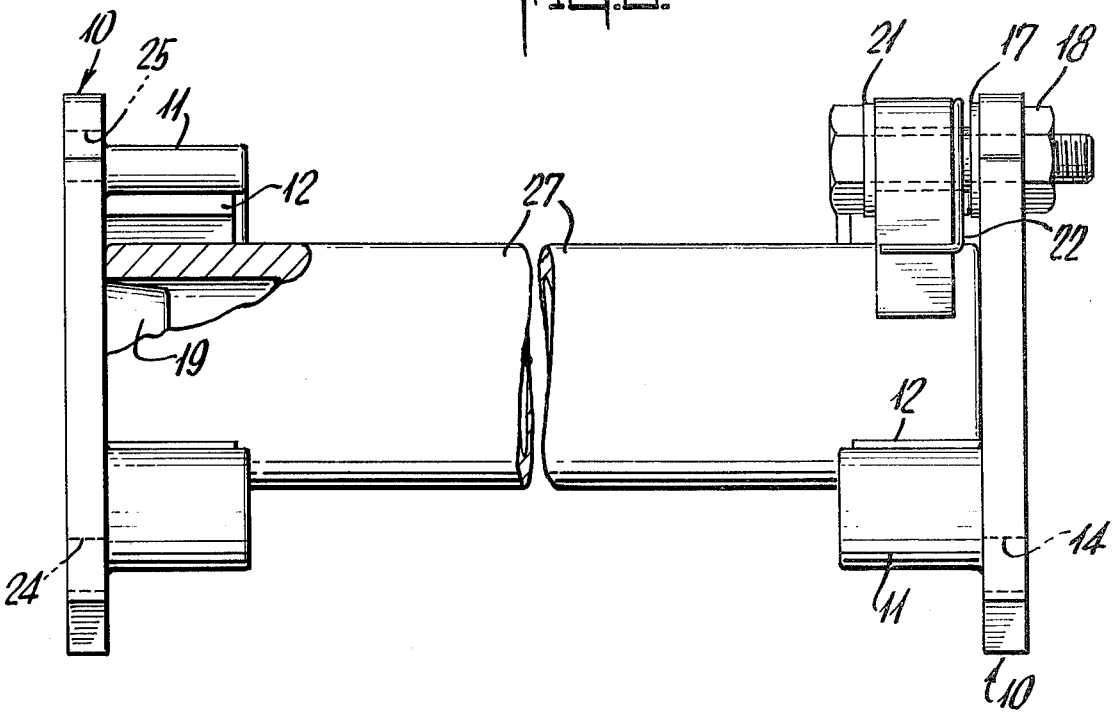
FIG. 3 is a top plan view of the cushion block assembly of the present invention.

FIG. 3 shows the two cushion blocks with one end of member 27 positioned over hub 19 and supported by U-shaped portion 11 of one cushion block. The hub 19 serves to lock the cylinder 27 in its position in the cushion block. The other end of member 27 is supported by the substantially U-shaped portion 11 of the other cushion block with locking lever member 15 preventing member 27 from being displaced from the cushion block.

With the cushion block assembly of the present invention the bowling ball backstop can be removed simply by releasing the lever. The job can be easily accomplished by one man in a few seconds. The presently used cushion block assembly on the other hand, have to be removed by a team of two men before the bowling ball backstop can be removed. The cushion block assembly of the present invention permits the cylinder to rotate when the bowling ball backstop is struck by a bowling ball but because the cylinder is locked in position in the cushion block, the bowling ball cannot be wedged under the bowling ball backstop even when the shock absorber is worn.

While a specific lever locking means has been illustrated and described, other equivalent means are contemplated as being within the scope of the invention. For example, the locking means may consist of a member adapted to fit over the opening of the substantially U-shaped member and to be secured thereto so as to form a substantially circular opening which maintains the cylinder in the cushion block.

What is claimed is:

1. In a cushion block assembly having two end supports for a cylinder which supports a bowling ball backstop for an automatic pinsetter or pinspotter, the improvement wherein one end support comprises a plate having a raised substantially U-shaped portion, the inner surface of the U-shaped portion having a layer of cushioning material to provide a bearing surface for the cylinder, a locking member adapted to cooperate with the substantially U-shaped portion to lock the cylinder into the substantially U-shaped portion and to permit rapid removal and installation of the cylinder.

2. A cushion block assembly according to claim 1 wherein the locking member is a lever member which pivots away from the opening of the substantially U-shaped portion to permit removal of the cylinder and which pivots toward the opening of the substantially U-shaped portion to lock the cylinder in the U-shaped portion.

3. A cushion block assembly according to claim 2 having spring means to bias the lever member into engagement with the cylinder.

4. In a cushion block assembly having two end supports for a cylinder which supports a bowling ball backstop for an automatic pinsetter or pinspotter, the improvement wherein one end support comprises a plate having a raised substantially U-shaped portion, the inner surface of the U-shaped portion having a layer of cushioning material, and a hub located within the substantially U-shaped portion adapted to lock the cylinder in the substantially U-shaped portion and to permit rapid removal and installation of the cylinder.

5. A cushion block assembly according to claim 4 wherein the hub is substantially frusto-conical.

6. A cushion block assembly having two end supports for a cylinder which supports a bowling ball backstop for an automatic pinsetter or pinspotter consisting of a first cushion block comprising a plate having a raised substantially U-shaped portion, the inner surface of the U-shaped portion having a layer of cushioning material, a locking member adapted to cooperate with the substantially U-shaped portion to lock the cylinder into the substantially U-shaped portion and to permit rapid removal and installation of the cylinder and a second cushion block comprising a plate having a raised substantially U-shaped portion, the inner surface of the U-shaped portion having a layer of cushioning material, and a hub located within the U-shaped portion adapted to lock the cylinder in the second cushion block.

7. A cushion block assembly according to claim 1 wherein the locking member is a lever member pivotally mounted above the substantially U-shaped portion.

8. A cushion block assembly according to claim 6 wherein the locking member is a lever member which pivots away from the opening of the substantially U-shaped portion to permit removal of the cylinder and which pivots toward the opening of the substantially U-shaped portion and engages the cylinder to lock the cylinder in the first cushion block.

9. A cushion block assembly according to claim 8 having spring means to bias the lever member into engagement with the cylinder.

10. A cushion block assembly according to claim 6 wherein the hub is substantially frusto-conical.

11. A cushion block assembly according to claim 6 wherein the locking member is a lever member pivotally mounted above the substantially U-shaped portion.

12. In an automatic pinsetter or pinspotter having a bowling ball backstop supported by a cylinder, each end of the cylinder being supported in a U-shaped block, the improvement which comprises providing each U-shaped block with a layer of cushioning material on the inner surface thereof to provide a bearing surface for the cylinder and with a locking member to lock the cylinder therein.

13. A device according to claim 12 wherein the locking member of one U-shaped block is a lever member which pivots away from the opening of the U-shaped block to permit removal of the cylinder and which pivots toward the opening of the U-shaped block to lock the cylinder therein.

14. A device according to claim 12 wherein the locking member of one U-shaped block is a hub located within the U-shaped portion of the block and adapted to lock the cylinder therein.

15. A device according to claim 13 having spring means to bias the lever member into engagement with the cylinder.

16. A device according to claim 14 wherein the hub is substantially frusto-conical.

17. A device according to claim 15 whereinthe locking member of other U-shaped block is a frusto-conical hub located within the U-shaped portion of the block and adapted to lock the cylinder therein.

18. A device according to claim 11 wherein the lever member is pivotally mounted above the opening of the U-shaped block.

19. A cushion block assembly according to claim 4 wherein the hub is fixed.

* * * * *